US006050837A

United States Patent [19]

Duhe, Jr.

[11] Patent Number: 6,050,837

[45] Date of Patent: Apr. 18, 2000

[54] ELECTRICAL LOCKING PLUG

[76] Inventor: Jerry R. Duhe, Jr., P.O. Box 10626, College Station, Tex. 77842

[21] Appl. No.: 09/178,950

[22] Filed: Oct. 26, 1998

Related U.S. Application Data

[60] Provisional application No. 60/063,639, Oct. 27, 1997.

[51] Int. Cl.[7] ..... H01R 11/22

[52] U.S. Cl. ..... 439/270

[58] Field of Search ..... 439/270, 102, 439/324, 346, 265

[56] References Cited

U.S. PATENT DOCUMENTS

| | | |
|---|---|---|
| 1,671,550 | 5/1928 | Semmens . |
| 1,771,757 | 7/1930 | Keeper . |
| 2,047,623 | 7/1936 | Felts . |
| 2,498,743 | 2/1950 | Theriault . |
| 2,546,201 | 3/1951 | Theriault . |
| 2,885,650 | 5/1959 | Miller et al. . |
| 3,187,291 | 6/1965 | Hime . |
| 3,267,408 | 8/1966 | Baker et al. . |
| 3,345,603 | 10/1967 | Cohen . |
| 3,390,404 | 6/1968 | Murchison . |
| 3,676,831 | 7/1972 | Bergwall . |
| 4,544,216 | 10/1985 | Imhoff . |
| 5,082,450 | 1/1992 | Warren et al. . |
| 5,194,013 | 3/1993 | Propp . |
| 5,249,976 | 10/1993 | Brock . |

*Primary Examiner*—Steven L. Stephan
*Assistant Examiner*—J. F. Duverne
*Attorney, Agent, or Firm*—McAndrews, Held & Malloy, Ltd.

[57] ABSTRACT

A locking electrical plug 1 includes a plug body 8 and a securement arm 18 residing in a securement arm slot 32 located in the flat of a power blade 16. The securement arm 18 is normally biased orthogonal to the flat of the power blade 16 by a biasing member 20. The securement arm 18 includes a securing nib 25 capable of mating with the biasing member 20. In the normal locked position, the securing nib 25 is not mated with the biasing member 20 causing the securement arm 18 to extend orthogonally outward from the securement arm slot 32. When the securement arm 18 is slid along the major axis of the power blade 16 towards the unlocked position, the biasing member 20 and the securing nib 25 mate such that the securement arm 18 lies in the flat of the power blade 16. A shaft 14 is positioned in the plug body 8 and allows a user to control the locked/unlocked characteristics of the locking electrical plug 1. In one embodiment a spring 15 acts to position the securement arm 18 in the normal locked position.

16 Claims, 6 Drawing Sheets

25
18
22a
13
29

13
22b
29

61
14
21a 14
21a 33
18
62
13
22a
25
34
15
23

13
14
18
61

10
14
9
8
11

24
32
20
16
19
12
15
32
20
18
16
25
19
17
62

66
14
39
13
67
15
18
25

FIG. 13B
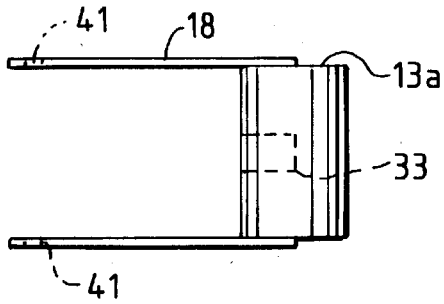
FIG. 13A
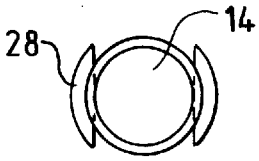
FIG. 13C
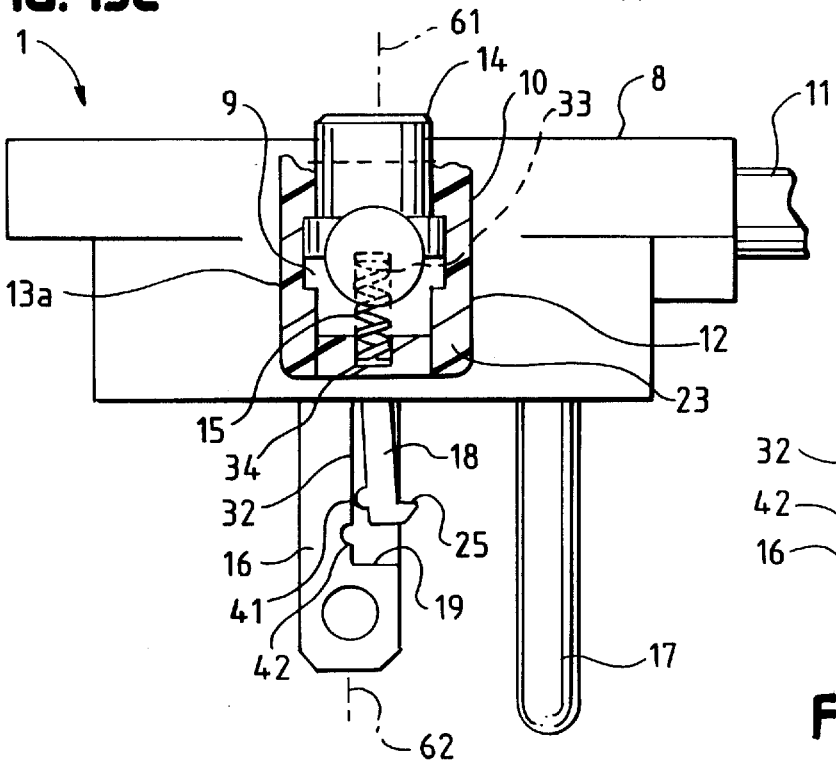
FIG. 13E
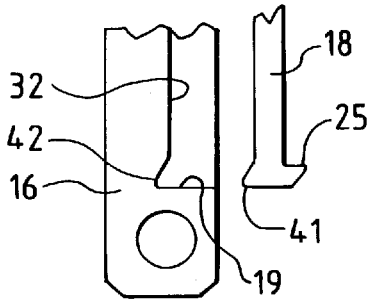
FIG. 13D

ELECTRICAL LOCKING PLUG

CROSS-REFERENCE TO RELATED APPLICATIONS

The present application is based on, and claims priority from, provisional application Ser. No. 60/063,639, filed Oct. 27, 1997, entitled "Mother of All Locking Plugs", which is incorporated herein in its entirety by reference.

STATEMENT REGARDING FEDERALLY SPONSORED RESEARCH OR DEVELOPMENT

Not applicable

REFERENCE TO APPENDIX

Not applicable

BACKGROUND OF THE INVENTION

1. Field of the Invention

The present invention relates generally to an electrical plug, and more specifically to an electrical plug which locks the plug into an electrical outlet to prevent accidental disengagement of the plug from the outlet.

2. Description of the Related Art

Electrical power cords are used to carry electricity from electrical outlets to a multitude of electrical devices. These devices are heavily used almost everywhere in the world. Unfortunately electricity is not only useful; it is highly dangerous. The electrical energy carried by typical electrical cords is quite capable of inflicting serious injury or even death to a person who comes into direct contact with it.

Inadvertent contact with dangerous amounts of electrical energy can happen in many ways. For instance, a partially plugged electrical connector is still capable of carrying electrical energy, but fingers especially the small fingers of children, can easily reach the exposed power blades of the electrical plug. Another danger of a partially plugged electrical plug is that of intermittent power. The user of an electrical device, such as an electric saw, may turn the device on, observe no action, and assume the device is not powered. However, a slight jostling of the electrical cord providing electricity to the device may provide power to the device unbeknownst to the user. The user may then treat a powered device as though it were not powered, and serious injury may result. A third category of dangerous electrical situation is that in which a powered electrical device is causing harm and the electrical plug cannot be easily reached. In this situation, a locking electrical plug that was designed and built with safety in mind becomes a hazard itself. Thus, the Underwriters Laboratory has written specifications for the minimum force that it should take to remove an electrical plug from an outlet AND the maximum force that it should take to remove an electrical plug from an outlet.

The danger inherent in electricity is not new, nor is the concept of locking electrical plugs. Thus there exists many designs for locking electrical plugs. However, the existing designs all have drawbacks that need to be addressed. Many of the existing designs require the presence of a ground pin (e.g. Brock, U.S. Pat. No. 5,249,976, Warren, Sr. et al., U.S. Pat. No. 5,082,450, and Imhoff, U.S. Pat. No. 4,544,216). Though the use of ground pins is generally accepted as safer than the alternative, their use is hardly universal. Other locking plug designs require the use of a turning tool (e.g. Propp, U.S. Pat. No. 5,194,013 and Cohen, U.S. Pat. No. 3,345,603). Unplugging the Propp and Cohen designed plugs without their respective turning tools, which may not be handy in an emergency situation, would require forces of unsafe magnitudes. Other locking plugs are prohibitively complex for the production demands of modern commerce. In addition, many of the existing plug designs are not meant to be unplugged by merely pulling on the cord with a deliberate force within the Underwriters Laboratory maximum limit (e.g. Brock, U.S. Pat. No. 5,249,976, Murchison, U.S. Pat. No. 3,390.404, Bergwall, U.S. Pat. No. 3,676,831, Baker et al. U.S. Pat. No. 3,267,408, Hime, U.S. Pat. No. 3,187,291, and many others). Many of the designs just listed would require physically damaging the locking plug or the electrical outlet to unplug the locking plug without operating the release mechanism. Lastly, manufacturability, and thus product reliability at a reasonable cost to the consumer, is rarely addressed, especially with older locking plug designs There exists a need for a locking electrical plug capable of remaining plugged under rigorous usage, capable of remaining plugged under the small pulling forces experienced during normal electrical device use and also the small forces provided by children, and capable of being unplugged by the application of a reasonable pulling force without the operation of a release mechanism. In addition, there exists a need for a locking electrical plug which is reliable and cost effective to both produce and purchase.

OBJECTS AND SUMMARY OF THE INVENTION

It is therefore an object of the present invention to provide an improved locking electrical plug.

It is another object of the present invention to provide an improved locking electrical plug capable of remaining plugged under rigorous use.

It is a further object of the present invention to provide an improved locking electrical plug capable of remaining plugged when subjected to the pulling forces applied by small children.

It is a still further object of the present invention to provide an improved locking electrical plug capable of being unplugged, without operation of the release mechanism, by the application of a deliberate pulling force exceeding that typically applied by small children but within maximum safety limits.

It is also an object of the present invention to provide an improved locking electrical plug with manufacturability in mind so that the locking plug can be produced with high quality and at a low cost to both the producer and the consumer.

These objects and others are achieved by providing a locking plug according to the present invention. A preferred embodiment of the present invention provides a locking electrical plug, which includes a plug body and two power blades capable of being plugged into a conventional electrical outlet. A securement arm slot is provided in the flat of at least one of the power blades running along the major axis of the power blade. A securement arm is slidably positioned in the securement arm slot so that it may be slid along the major axis of the power blade. An instruction member is provided in the securement arm slot which acts to bias the securement arm orthogonal to the flat of the power blade when the securement arm is pushed over the instruction member. A shaft is provided which extends from the plug body. The shaft contacts the securement arm internal to the plug body so that a user of the locking electrical plug may control the position of the securement arm in the securement arm slot by manipulating the shaft. A spring is provided which maintains the securement arm in a normal position in which the securement arm is over the instruction member and thus biased in the locking position. A user wishing to release the locking mechanism has only to apply pressure to the shaft which in turn slides the securement arm away from the instruction member and to the unlocked position.

These and other features of the present invention are discussed or apparent in the following detailed description.

BRIEF DESCRIPTION OF THE DRAWINGS

FIG. 13 illustrates views of a keyed embodiment of the present invention.

DETAILED DESCRIPTION OF THE PREFERRED EMBODIMENT

Figure 1A:
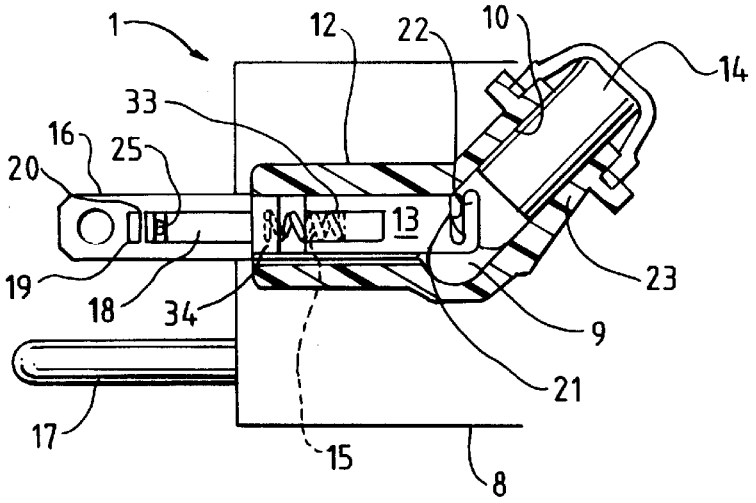
FIGS. 1A and 1B illustrate top and side cutaway views of a locking plug in the locked position according to a preferred embodiment of the present invention.
Figure 1B:
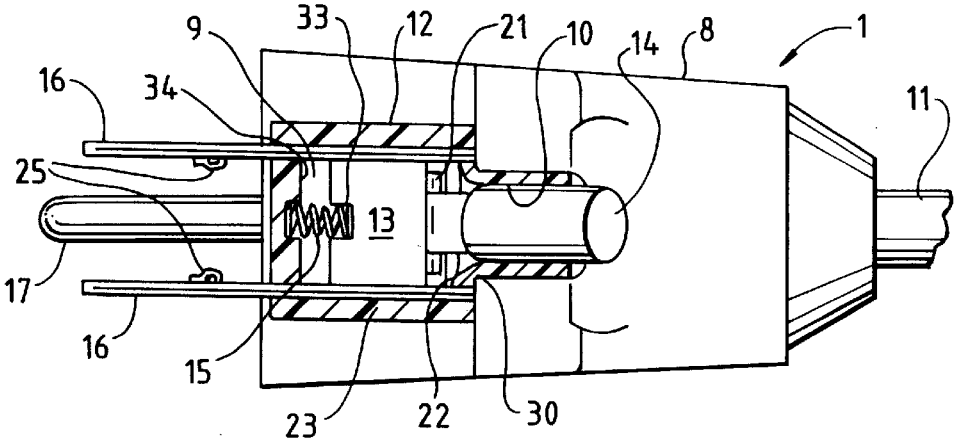

Referring to FIGS. 1A and 1B, a locking electrical plug 1 has a plug body 8 formed of any suitable electrically insulating material. The locking plug 1 is typically attached to an electrical cord 11 having a protective electrically insulating external layer. The plug 1 is conventionally provided with a pair of power blades 16 for establishing an electrical connection with a source of electrical energy. The power blades 16 are electrically connected to the conductors of the electrical cord 11. This connection is typically made within the confines of the plug body 8. Thus the power blades 16 have an inner-plug portion and an outer-plug portion. The plug 1 may also be provided with a ground pin 17. However, the existence of a ground pin is not necessary for the function of the preferred embodiment.

The power blades 16 are provided with a pair of movable securement arms 18, one on each of the power blades 16. The securement arms 18 slide in securement arm slots (32 in FIG. 5). The securement arms 18 may be made of any suitable material of adequate strength and resiliency such as spring steel and other metals or plastics. FIG. 5 illustrates a variety of options for securement arms 18 and securement arm slots 32. Illustration A of FIG. 5 shows a securement arm slot 32 located in the flat of a power blade 16. There is a registration member 20 located in the securement arm slot 32 and fixedly attached therein. For illustration purposes, the securement arm 18 is shown apart from the securement arm slot 32. However, for operation of the preferred embodiment, the securement arm 18 is slidably positioned in the securement arm slot 32. A securing nib 25 is provided as part of the securement arm 18. When the locking plug 1 is in its normal locked position, the securement arm 18 (but not the securing nib 25) is positioned over the registration member 20, which acts to bias the securement arm 18 orthogonally outward from the flat of the power blade 16. When the locking plug 1 is in its unlocked position, the securing nib 25 of the securement arm 18 is positioned directly over the registration member 20 thereby allowing the securement arm 18 to lie entirely within the securement arm slot 32. The elasticity of the securement arm 18 acts to keep the securement arm 18 entirely within the confines of the securement arm slot 32.

The other configurations illustrated in FIG. 5 behave in a similar manner. For example, illustrations C and D of FIG. 5 show a securement arm registration design in which there is a registration hole 50 in the securement arm slot 32. A registration nodule 40 is provided on the securement arm 18. When the locking plug 1 is in the unlocked position, the registration nodule 40 is positioned in the registration hole 50 thereby allowing the securement arm 18 to lie entirely within the securement arm slot 32. When the locking plug 1 is in the locked position, the registration nodule 40 is not positioned in the registration hole 50 and acts to bias the securement arm 18 orthogonally outward from the flat of the power blade 16.

Referring back to FIGS. 1A and 1B, the dual securement arms 18 are attached to a carriage 13. A spring 15 is positioned in the carriage spring slot 33 and the plug body spring slot 34. The spring 15 acts to normally position the securement arms 18 in the locked position which was discussed above. The spring also enables a valuable safety feature which will be discussed later.

A shaft 14 positioned in and extending from the plug body 8 is provided for allowing the user of the locking plug 1 to control the locked/unlocked characteristic of the locking plug 1. The shaft 14 is located in a channel 10 which terminates in a chamber 9 internal to the plug body 8. In the embodiment illustrated in FIG. 1, the shaft 14 and carriage 13 are separate mechanical pieces. Thus the shaft 14 may be made of a large number of suitable materials, including both insulative materials and conductive materials since the shaft does not physically contact any electrical current carrying members. To enable the depressing/releasing motion of the shaft 14 to control the motion of the carriage 13 and ultimately the motion of the securement arms 18, the shaft 14 and carriage 13 are connected. In the embodiment illustrated in FIG. 1, this connection is accomplished with a positioning member 21 on the shaft 14 and a restriction member slot 22 on the carriage 13. The positioning member 21 is located in the restriction member slot 22, and the combination serves as a transmission between the motion of the shaft 14 and the motion of the carriage 13. This transmission is located in the chamber 9 at the end of the channel 10.

Figure 6:
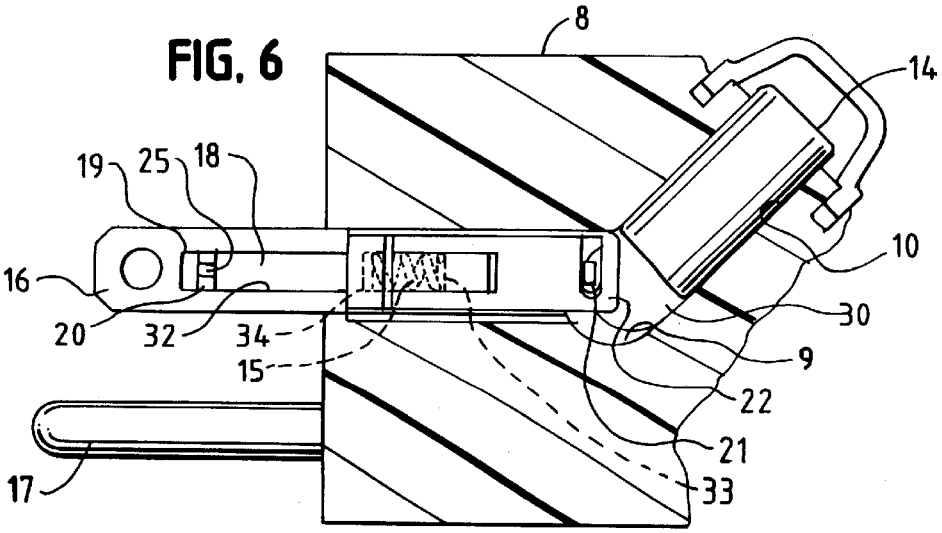
FIG. 6 is a view of a variation of the preferred embodiment of the present invention without a sleeve.

Note that the embodiment illustrated in FIG. 1 shows the plug body 8 containing a passage 12 into which a sleeve 23 is inserted. The passage 12 and sleeve 23 are not necessary components of the present invention and may be omitted, see FIG. 6. However, they may aid in manufacturing and mass production of the locking plug 1.

Figure 2A:
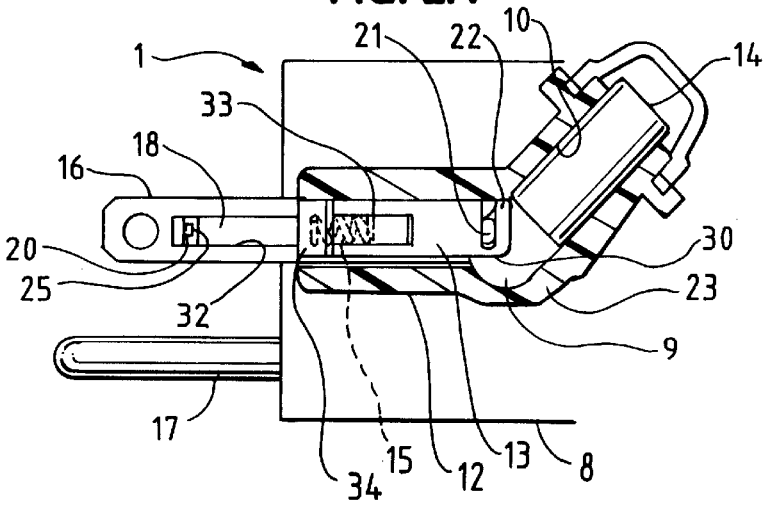
FIGS. 2A and 2B illustrate top and side cutaway views of a locking plug in the unlocked position according to a preferred embodiment of the present invention.
Figure 2B:
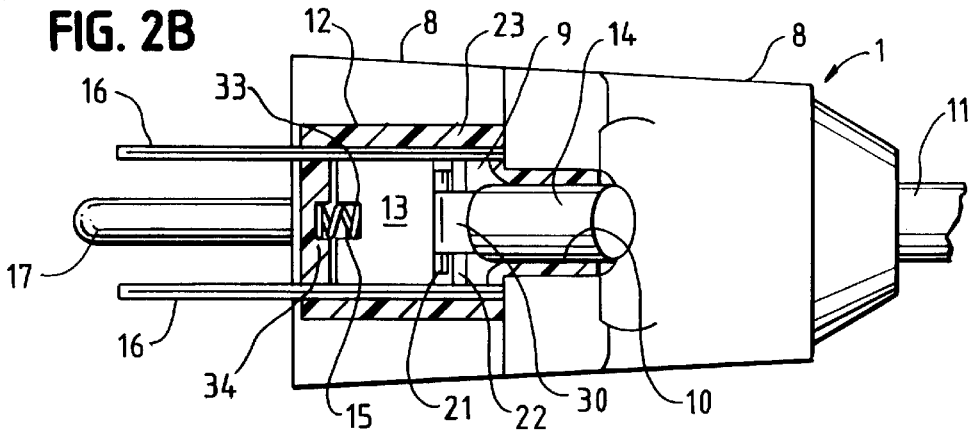

FIGS. 2A and 2B are provided to illustrate the position of the components when the locking plug 1 is in the unlocked position, as opposed to FIGS. 1A and 1B which illustrate the position of the components when the locking plug 1 is in the locked position. A user unlocks the locking plug 1 by depressing the shaft 14 into the plug body 8. Compare the normal locked position of the shaft 14 in FIG. 1 and the unlocked position of the shaft 14 in FIG. 2. Depressing the shaft 14 simultaneously causes the carriage 13 to move forward within the chamber 9 against the spring 15. Compare the normal locked position of the carriage 13 in FIG. 1 to the unlocked position of the carriage 13 in FIG. 2. Since the securement arms 18 arc attached to the carriage 13, the forward motion of the carriage 13 results in forward motion of the securement arms 18 in the securement arm slots (32 of FIG. 5). Recalling the earlier discussion regarding FIG. 5. the forward motion of the securement arms 18 enables the securement arms 18 to assume the unlocked position. Compare the biased position of the securing nib 25 in FIG. 1 to the unbiased position of the securing nib 25 in FIG. 2.

Figure 3:
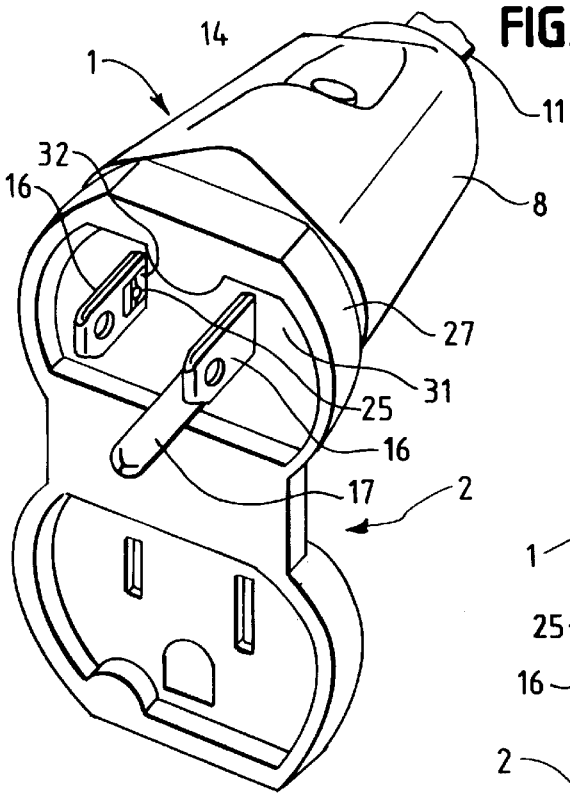
FIG. 3 is a view of a locking plug according to a preferred embodiment of the present invention in the unlocked position and plugged into a conventional outlet.
Figure 4:
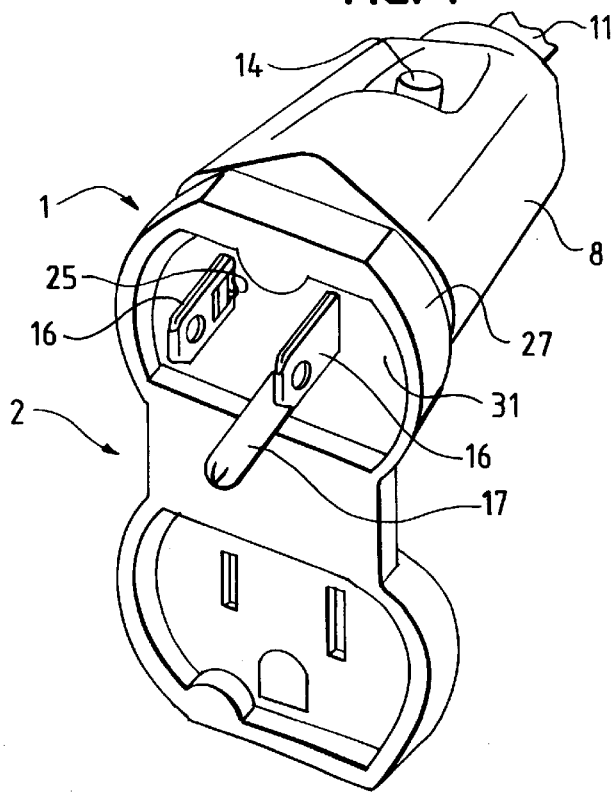
FIG. 4 is a view of a locking plug according to a preferred embodiment of the present invention in the locked position and plugged into a conventional outlet.
Figure 5A:
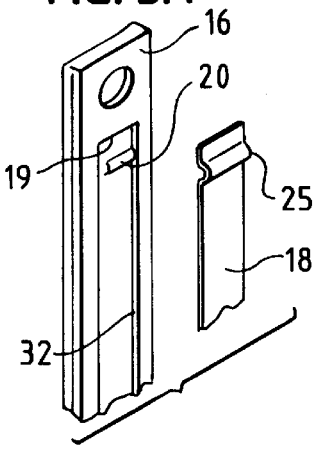
FIG. 5 illustrates a variety of securement arm designs.
Figure 5B:
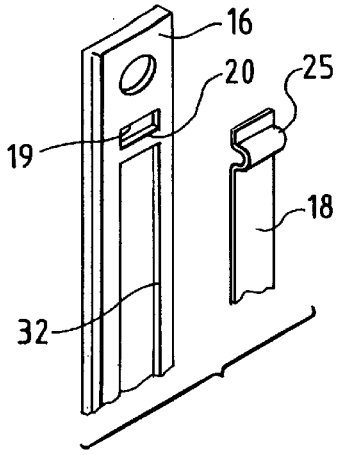
Figure 5C:
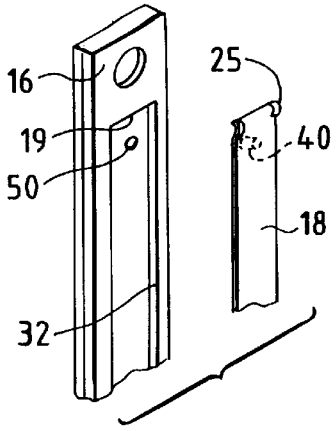
Figure 5D:
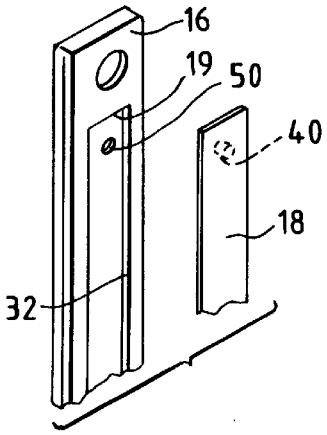
Figure 5E:
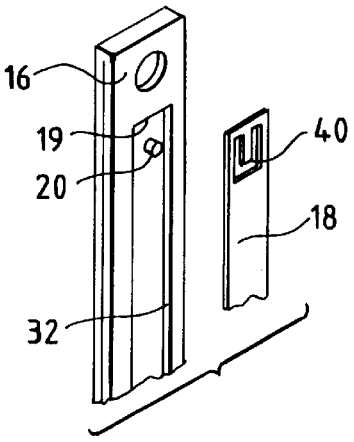
Figure 5F:
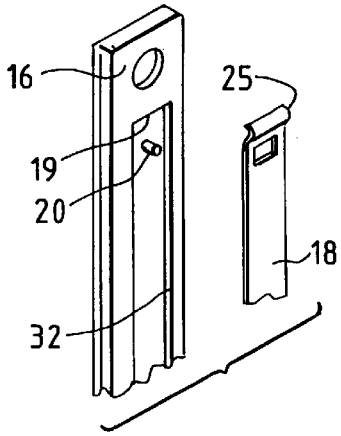

FIG. 3 and FIG. 4 serve to illustrate the interaction of the exterior components of the locking plug 1 with parts of a conventional electrical outlet 2. FIG. 3 illustrates the locking plug 1 in the unlocked position and inserted into an electrical outlet 2. Note the depressed shaft 14, which would in operation be depressed by the user of the locking plug 1. Also note that the securing nib 25 is entirely recessed into the securement arm slot 32 in its respective power blade 16. The securing nib in this recessed position poses no hindrance to the motion of the locking electrical plug into and out of the electrical outlet 2. FIG. 4 illustrates the locking plug 1 in the locked position and inserted into the receptacle face 27 of an electrical outlet 2. Note the outwardly extended position of the shalt 14 relative to the inwardly depressed position of the shaft illustrated in FIG. 3. The spring, 15 discussed earlier acts to normally maintain the locking plug 1 component positions illustrated in FIG. 4. Note the extended position of the securing nibs 25 relative to the recessed position of the securing nibs 25 illustrated in FIG. 3. The securing nibs 25 of FIG. 4 are in a position which communicates with, i.e., contacts against, the inner receptacle face 31 of the electrical outlet 2, and thus resist the extraction of the locking plug 1 from the electrical outlet 2.

An alternative embodiment of the present invention may rely on friction to resist the extraction of the locking plug 1 from an electrical outlet versus the mechanical interference approach just discussed. The securement mechanism designs shown in illustrations D and E of FIG. 5 operate on a friction principal. Note the absence of any mechanical extrusions from the outward side of the securement arms 18. The designs in illustrations D and E rely on the outwardly biased positions of the securement arms 18 to increase the effective width of the power blade 16 to a width which resists the extraction of the locking plug 1 from an electrical outlet.

A significant feature of the present invention is that it allows for the extraction of the locking electrical plug from an electrical outlet without direct operation of the release mechanism by the user. As mentioned previously, the Underwriters Laboratory has determined a maximum amount of force that it should take to pull a plug from an electrical outlet without the operation of a release mechanism. As a pulling force is applied to the locked locking plug 1 of FIG. 4. the interaction between the inner receptacle face 31 and the securing nib 25 resist the extraction of the locking plug 1. This results in a force pulling the securing nib 25 toward the end of its respective power blade 16. Referring back to FIG. 1, the pulling force applied to the securing nibs in the direction of the exterior end of the power blades 16 results in the compression of the spring 15 which in turn allows a sliding motion of the securement arms 18 to occur. When the securement arms 18 are forcibly slid against the spring to a position where the instruction member 20 no longer biases the securement arms 18 outward from the power blades 16, the securement arms 18 are allowed to retract into the confines of their respective securement arm slots (32 of FIG. 5). Once the securement arms 18 retract into their respective securement arm slots (32 of FIG. 5), the securement arms no longer act to resist the extraction of the locking plug 1 from the electrical outlet (2 of FIG. 4). The force required to forcibly extract the locking electrical plug 1 from an outlet is determined by the stiffness of the spring 15. In addition, the interaction between the positioning member 21 and the restriction member slot 22 from the embodiment illustrated in FIG. 1 may be designed to determine the plug extraction force.

Figure 7:
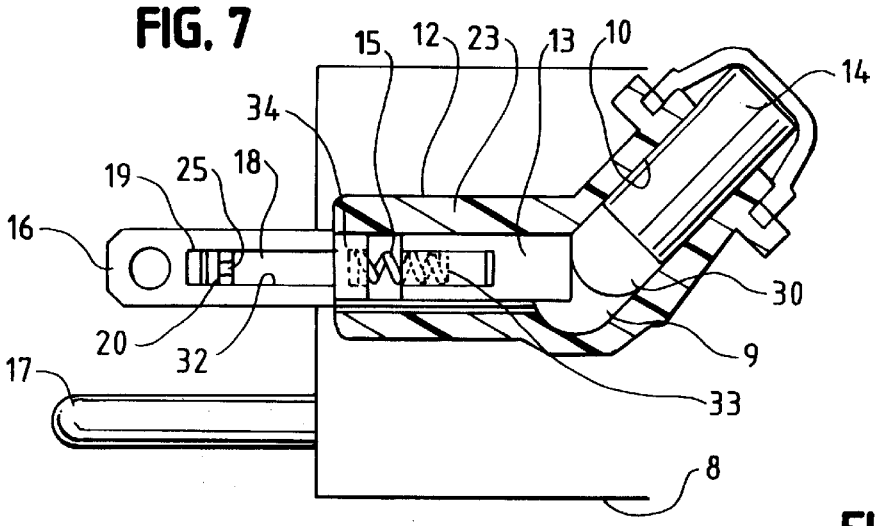
FIG. 7 is a view of a variation of the preferred embodiment of the present invention without a positioning member.

FIG. 7 illustrates an alternative embodiment of the present invention which omits the positioning member 21 and restriction member 22 of the embodiment illustrated in FIG. 1. Interaction between the interior end 30 of the shaft 14 and the carriage 13 replace the interaction between the positioning member 21 and the restriction member 22 of the embodiment of FIG. 1.

Figure 8:
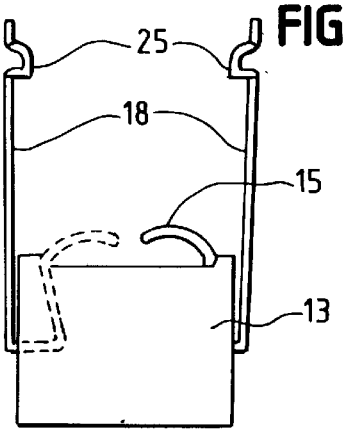
FIG. 8 is a view of a spring/securement arm subassembly.
Figure 9:
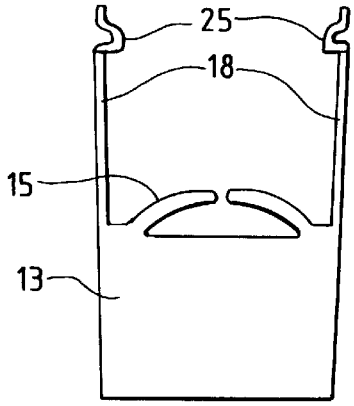
FIG. 9 is a view of a one-piece spring/securement arm design.
Figure 10:
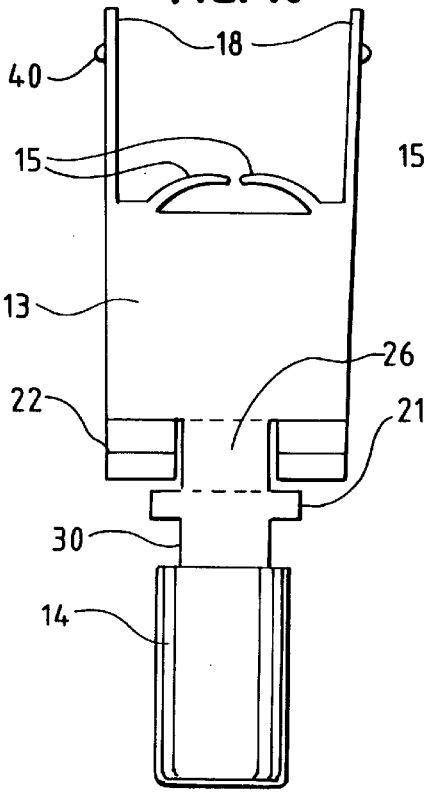
FIG. 10 is a view of a one-piece shaft/spring/securement arm design.
Figure 10A:
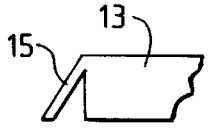

FIGS. 8–10 illustrate subassembly and part designs which address manufacturability concerns. FIG. 8 illustrates a one-piece spring/securement arm subassembly. The subassembly shown in FIG. 8 combines two securement arms 18 and a spring 15 into two mechanical parts. FIG. 9 illustrates a one-piece spring/securement arm/carriage combination. The combination shown in FIG. 9 combines two securement arms 18, a spring 15 and a carriage 13 into one mechanical part. FIG. 10 illustrates a one-piece spring/securement arm/carriage/transmission/shaft combination. The combination shown in FIG. 10 combines two securement arms 18, a spring 15, a carriage 13, the interior end 30 of the shaft 14 and a shaft-movement-to-carriage-movement transmission member 26 into one mechanical part. The subassembly design shown in FIG. 10 provides the preferred embodiment of the present invention a high degree of manufacturability and reliability.

Figures 11A, 11B, 11C, 11D, 11E, 12A, 12B, 12C, 12D:
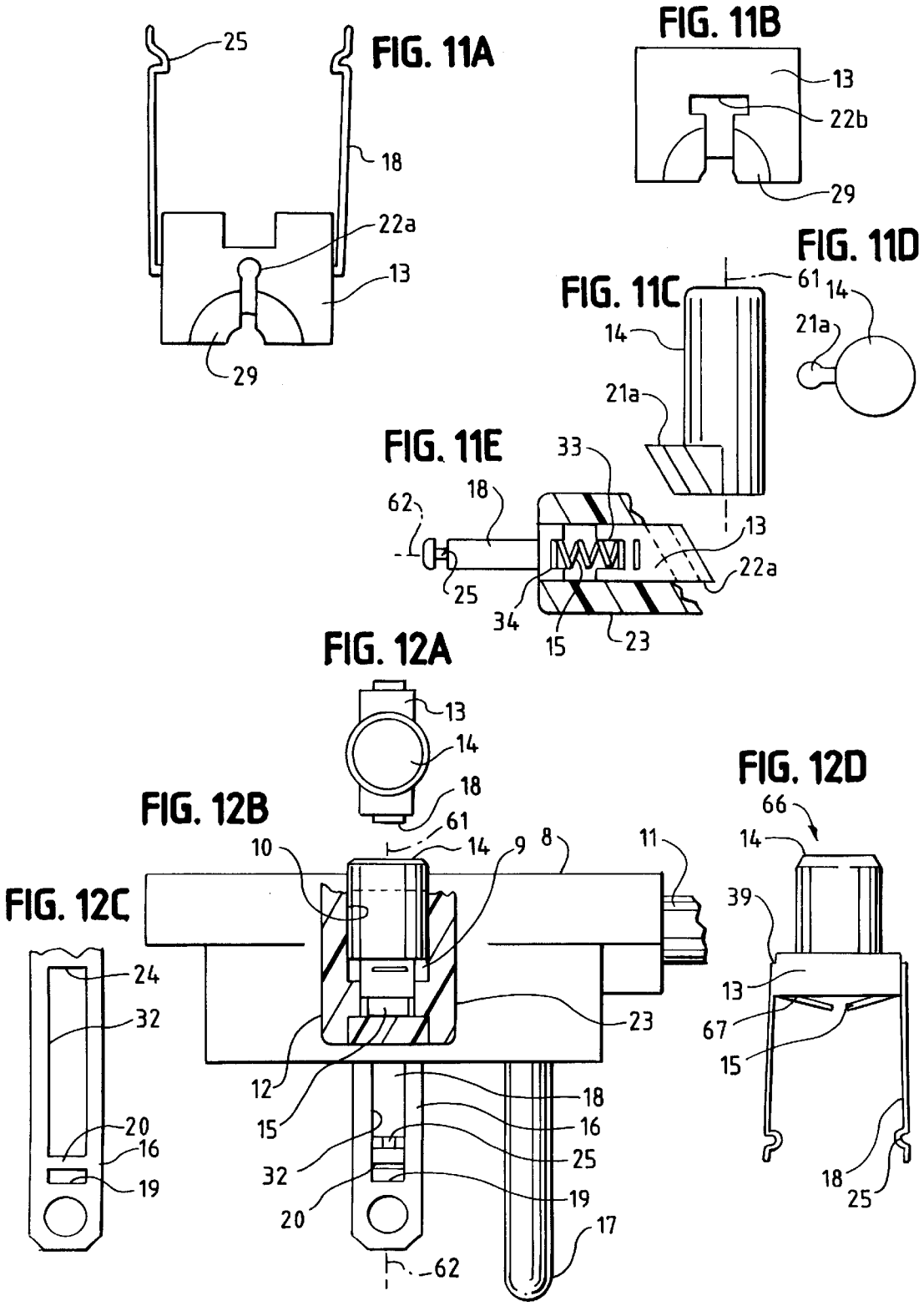
FIG. 11 illustrates views of a right-angle embodiment of the present invention.
FIG. 12 illustrates views of a linear embodiment of the present invention.

FIG. 11 illustrates an embodiment of the present invention with the major axis 61 of the shaft 14 approximately orthogonal to the major axis 62 of the power blades and securement arm 18. FIG. 11A illustrates a carriage 13 with a modified restriction member slot 22A (22B in FIG. 11B). The carriage 13 also includes a sloped face 29 for the transmission of shaft 14 linear motion to carriage 13 lateral motion. FIG. 11C illustrates a side view of the assembly. The sloped positioning member 21A of the shaft 14 interacts with the sloped face 29 of the carriage 13.

FIG. 12 illustrates an embodiment of the present invention in which the major axis 61 of the shaft 14 is in line with the major axis 62 of the securement arms 18 and power blades 16. This embodiment leads to the one-piece spring/securement arm/shaft subassembly 66 illustrated in FIG. 12. The operational range of motion of the subassembly 66 is governed in part by the dimensions of the carriage 13 including the shoulder 39 and base 67.

FIG. 13 illustrates a keyed embodiment of the present invention. A keyed design is used for the securement arm 18 which hooks or catches on the inside face of an electrical outlet when the locking electrical plug 1 is in the locked position. FIG. 13 particularly illustrates the locked configuration of the locking electrical plug 1. When the shaft 14 is depressed, the carriage 13*a* moves forward thereby moving the securement arms 18 forward also. As the shaft 14 terminates its inward movement, the carriage 13*a* turns on its minor axis slightly as the nodule 41 near the tip of the securement arm 18 moves within the nodule recess 42. This movement is directed by the straightening of the spring 15, which up to the point of straightening has been affected by a slight bending force. When the nodule 41 is seated in the nodule recess 42, the securing nib 25 is entirely contained with the bounds of the securement arm slot 32. Upon release of the shaft 14, the spring 15 will pull the nodule 41 out of the nodule recess 42, thus forcing the securement nib 25 to extend out of the securement arm slot 32. The securement arm 18 will follow the releasing motion of the shaft 14 until the nib 25 catches on the inner face of the electrical outlet plate. Though the keyed embodiment illustrated in FIG. 13 is an embodiment in which the major axis 61 of the shaft 14 is in line with the major axis 62 of the securement arms 18 and power blades 16, it will be understood by one of ordinary skill in the art that the angle between the major shaft axis 61 and the major securement arm axis 62 may vary.

While particular elements, embodiments and applications of the present invention have been shown and described, it will be understood, of course, that the invention is not limited thereto since modifications may be made by those skilled in the art, particularly in light of the foregoing, teachings. It is therefore contemplated by the appended claims to cover such modifications as incorporate those features which come within the spirit and scope of the invention.

What is claimed is:

1. A locking electrical line cord plug comprising:

a plug body;

a first power blade and a second power blade, said power blades sized and positioned for plugging into a conventional electrical outlet, said first power blade having a flat defining a plane inside of which allows unobstructed movement of said first power blade into and out of the outlet;

a longitudinal slot located in the flat of said first power blade, said longitudinal slot oriented along the longitudinal axis of said first power blade;

a securement arm slidably mounted in said slot, said securement arm slidable to occupy a first position and slidable to occupy a second position a securing nib located on said securement arm;

a biasing member fixedly positioned in said slot and shaped to mate with said securing nib when said arm occupies said second position, said securement arm and said securing nib lying inside of said plane of said power blade when mated in said second position, said biasing member biasing said securement arm to a lateral position outside of said plane of said first power blade when said arm occupies said first position; and a moveable member located within said plug body and having one end extending from said plug body to provide a surface for manual contact and the other end contacting said securement arm for sliding said securement arm within said slot, said moveable member biasing said securement arm into said first position to obstruct movement of said power blade into and out of the outlet.

2. The locking electrical line cord plug of claim 1, further comprising a spring contacting said securement arm, said spring acting to position said securement arm in said securement arm slot so that said biasing member and said securing nib are not aligned and mated.

3. The locking electrical line cord plug of claim 2, wherein said securement arm and said spring are combined into one piece.

4. The locking electrical line cord plug of claim 2, wherein said securement arm, said spring and said shaft are combined into one piece.

5. The locking electrical line cord plug of claim 2, further comprising a locking nib protruding from said securement arm generally away from the flat of said first power blade, said locking nib positioned on said securement arm and sized so that when said securement arm is biased away from said first power blade, said locking nib interacts with an electrical socket to inhibit unplugging said plug from the electrical socket.

6. The locking electrical line cord plug of claim 2, wherein said securement arm slot is located in the flat of said first power blade away from said second power blade.

7. The locking electrical line cord plug of claim 2, wherein said securement arm slot is located in the flat of said first power blade facing said second power blade.

8. The locking electrical line cord plug of claim 2, further comprising:

a second securement arm slot located in a flat of a second power blade, said second securement arm slot oriented along the major axis of said second power blade;

a second securement arm slidably positioned in said second securement arm slot, said second securement arm able to be slid in said second securement arm slot towards the plug body and away from the plug body, said second securement arm attached to said shaft;

a second securing nib located on said second securement arm; and a second biasing member fixedly positioned in said second securement arm slot and shaped to mate with said second securing nib when aligned with said second securing nib such that said second securement arm and said second securing nib lie in the flat of said second power blade, said second biasing member biasing said second securement arm outward from the flat of said second power blade when said second biasing member is not aligned and mated with said second securing nib.

9. The locking electrical line cord plug of claim 2, wherein the major axis of said shaft is in line with the major axis of said power blades.

10. The locking electrical line cord plug of claim 2, wherein the angle between the major axis of said shaft and the major axis of said power blades is ninety degrees.

11. A locking electrical line cord plug comprising:

a plug body;

a first power blade and a second power blade, said power blades sized and positioned for plugging said cord plug into a conventional electrical outlet;

a securement arm slot located in a flat of said first power blade, said securement arm slot oriented along the major axis of said first power blade;

a securement arm slidably positioned in said securement arm slot for lateral movement towards and away from said plug body, said securement arm rotatably mounted within the plane of said power blade allowing the distal end of said securement arm to rotate out of said securement arm slot;

a securing recess located in said securement arm slot;

a biasing member positioned on said securement arm and shaped to mate with said securing recess when aligned with said securing recess such that said securement arm lies in the flat of said power blade when said biasing member and said securing recess are aligned and mated, said biasing member biasing said securement arm such that the distal end of said securement arm may rise out of said securement arm slot within the plane of said power blade when said biasing member is not aligned and mated with said securing recess; and a moveable member located within said plug body and having one end extending from said plug body to provide a surface for manual depression and the other end contacting said securement arm for moving said securement arm within said securement arm slot, said moveable member biasing said securement arm with said first position to obstruct movement of said power blade into and out of the outlet.

12. The locking electrical line cord plug of claim 11, further comprising a spring contacting said securement arm, said spring acting to maintain the position of said securement arm in said securement arm slot so that said biasing member is between said securement arm and a wall of said securement arm slot thereby biasing said securement arm orthogonal to a narrow edge of said first power blade.

13. The locking electrical line cord plug of claim 12, further comprising a securing nib at the distal end of said securement arm, said securing nib protruding within the plane of said power blade and generally away from said securement arm slot, said nib interacts with an electrical socket to inhibit unplugging said plug from the electrical socket.

14. A locking electrical line cord plug comprising:

a plug body;

a first power blade and a second power blade, said power blades sized and positioned for plugging said cord plug into a conventional electrical outlet;

a ground pin attached to said plug body, said ground pin sized, spaced and positioned for plugging said cord plug into a conventional electrical outlet;

a securement arm slot located in said ground pin, said securement arm slot running along the major axis of said ground pin;

a securement arm slidably positioned in said securement arm slot, said securement arm able to be slid in said securement arm slot towards said plug body and away from said plug body;

a biasing member fixedly positioned in said securement arm slot, said biasing member biasing said securement arm orthogonal to the major axis of said ground pin when said biasing member is between said securement arm slot and said securement arm; and a moveable member located within said plug body and having one end extending from said plug body to provide a surface for manual depression and the other end contacting said securement arm for moving said securement arm within said securement arm slot, said moveable member biasing said securement arm with said first position to obstruct movement of said power blade into and out of the outlet.

15. The locking electrical line cord plug of claim 14, further comprising a spring contacting said securement arm, said spring acting to maintain the position of said securement arm in said securement arm slot so that said instruction member is between said securement arm and a wall of said securement arm slot thereby biasing said securement arm orthogonal to said ground pin.

16. A locking electrical line cord plug comprising:

a plug body;

a first power blade and a second power blade, said power blades sized and positioned for plugging said cord plug into a conventional electrical outlet;

a securement arm slot located in a flat of said first power blade, said securement arm slot oriented along the major axis of said first power blade;

a securement arm slidably positioned in said securement arm slot, said securement arm able to be slid in said securement arm slot towards said plug body and away from said plug body;

a securing recess located in said securement arm slot;

a biasing member fixedly positioned on said securement arm and shaped to mate with said securing recess when aligned with said securing recess such that said securement arm lies in the flat of said power blade when said biasing member and said securing recess are aligned and mated, said biasing member biasing said securement arm outward from the flat of said first power blade when said biasing member is not aligned and mated with said securing recess; and a moveable member located within said plug body and having one end extending from said plug body to provide a surface for manual depression and the other end contacting said securement arm for moving said securement arm within said securement arm slot, said moveable member biasing said securement arm with said first position to obstruct movement of said power blade into and out of the outlet.

* * * * *